US009783355B2

(12) United States Patent
Morin et al.

(10) Patent No.: US 9,783,355 B2
(45) Date of Patent: Oct. 10, 2017

(54) BOX FOR PACKAGING AN OBJECT

(71) Applicant: THOMSON LICENSING, Issy de Moulineaux (FR)

(72) Inventors: Pierre-Marie Morin, Sainte Gemmes sur Loire (FR); Didier Caban, Domagne (FR); Jean-Marc Le Foulgoc, Bourgbarre (FR)

(73) Assignee: Thomson Licensing, Boulogne, Billancourt (FR)

( * ) Notice: Subject to any disclaimer, the term of this patent is extended or adjusted under 35 U.S.C. 154(b) by 0 days.

(21) Appl. No.: 14/066,393

(22) Filed: Oct. 29, 2013

(65) Prior Publication Data

US 2014/0116914 A1 May 1, 2014

(30) Foreign Application Priority Data

Oct. 30, 2012 (FR) ..... 12 60386

(51) Int. Cl.
*B65D 81/02* (2006.01)
*B65D 5/50* (2006.01)

(52) U.S. Cl.
CPC ..... *B65D 81/025* (2013.01); *B65D 5/5002* (2013.01); *B65D 5/5021* (2013.01)

(58) Field of Classification Search
CPC .... B65D 25/06; B65D 25/04; B65D 5/48002; B65D 5/48014; B65D 5/5021; B65D 5/5002; B65D 85/30; B65D 5/5028; B65D 5/50; B65D 81/075; B65D 81/07; B65D 71/08; B65D 75/002; B65D 75/006
USPC ..... 206/521, 424, 586, 591, 592, 320, 453, 206/583, 594, 593, 701, 719, 721, 722, 206/723, 724; 220/531, 551, 530, 529, 220/557; 229/143
See application file for complete search history.

(56) References Cited

U.S. PATENT DOCUMENTS

| | | | | |
|---|---|---|---|---|
| 2,531,090 A | | 11/1950 | Turner | |
| 3,576,253 A | * | 4/1971 | Keats et al. | 206/783 |
| 3,618,758 A | * | 11/1971 | Shaw | B65D 85/542 206/436 |
| 3,741,380 A | * | 6/1973 | Carney | 206/783 |
| 4,951,813 A | * | 8/1990 | Sauter | 206/784 |

(Continued)

FOREIGN PATENT DOCUMENTS

| | | |
|---|---|---|
| DE | 1027590 | 4/1958 |
| EP | 1214256 | 11/2005 |

(Continued)

*Primary Examiner* — Anthony Stashick
*Assistant Examiner* — James M Van Buskirk
(74) *Attorney, Agent, or Firm* — Jeffrey D. Carter

(57) ABSTRACT

According to the invention, the box for packaging an object, comprising at least two upper edges, comprising:
- lateral walls,
- a delimiting bottom, with the lateral walls, an internal volume able to receive said object, and
- a moving cover in relation to at least one of said lateral walls, so as to be able to occupy at least one closed position and one open position, in which said receiving volume is respectively closed and open, characterized by the fact that the cover comprises, on its internal face oriented toward the receiving volume, at least two main flaps that are arranged opposite each other and that are designed to be applied respectively against the upper edges of said object, when the cover occupies the closed position.

14 Claims, 3 Drawing Sheets

(56) References Cited

U.S. PATENT DOCUMENTS

| | | | | | |
|---|---|---|---|---|---|
| 5,294,043 | A | * | 3/1994 | Platt | 229/143 |
| 5,361,907 | A | * | 11/1994 | Mohrhauser | 206/528 |
| 5,522,504 | A | * | 6/1996 | Levi | 206/424 |
| 5,529,187 | A | * | 6/1996 | DeNola | 206/449 |
| 5,562,227 | A | * | 10/1996 | Takezawa et al. | 229/117.13 |
| 5,950,912 | A | * | 9/1999 | Economopoulos | B65D 5/5021 229/120.32 |
| 6,685,026 | B1 | * | 2/2004 | Hanna | 206/586 |
| 7,604,119 | B2 | * | 10/2009 | Schott et al. | 206/454 |
| 2005/0115860 | A1 | | 6/2005 | Mertz, II et al. | |
| 2010/0236968 | A1 | | 9/2010 | De Jesus | |

FOREIGN PATENT DOCUMENTS

| | | |
|---|---|---|
| FR | 2892389 | 4/2007 |
| JP | 09249262 | 9/1997 |
| JP | 2000255674 | 9/2000 |
| JP | 2003292048 | 10/2003 |
| JP | 2007106480 | 4/2007 |
| JP | 04198138 | 12/2008 |
| JP | 2010047302 | 3/2010 |
| JP | 04455741 | 4/2010 |
| WO | WO 99/55590 | 11/1999 |

* cited by examiner

BOX FOR PACKAGING AN OBJECT

This application claims the benefit, under 35 U.S.C. §119 of French Patent Application 1260386, filed Oct. 30, 2012.

This invention relates to packaging boxes designed to protect a given object (for example a hard disk, a gateway for a domestic network, etc.) during its transport from a production site to the addressee customer.

It is known that, in a known manner, the packaging boxes comprise an internal receiving volume having a shape generally complementary to the shape of the object to be transported, in such a manner as to be able to house the latter with adjustment in said receiving volume. The movements of the object within the packaging box are thus reduced, or even fully removed. In this manner, the object can be handled and transported while remaining protected from shocks.

Nevertheless, some objects to transport comprise internal components or elements of great fragility and particularly sensitive to shocks. The suitable shape of the internal volume of the packaging boxes—although effectively protecting the exterior of the objects to transport—nevertheless remains ineffective for preventing the transmission of shock waves to the internal components or elements of these objects. Indeed, when the object is correctly supported, any movement in the volume is prohibited, such that the vibrations are directly transmitted to the internal components or elements of said object, which is able to damage them.

Hence, to overcome this disadvantage, it is known—for example from the document of patent JP2007106480A (published on Apr. 26, 2007, the applicant of which is KYOCERA MITA CORP)—to provide damper flaps on a parallelepipedic shaped packaging box. Each damper flap is formed by an extension of a lateral wall of the box, which has been folded back within the inside of the internal receiving volume. Hence, a packaging box can comprise one or more damper flaps of this type arranged on its lateral walls, so as to damp and brake the movement of the object to transport during a shock.

However, although these damper flaps absorb shocks experienced by the packaging box, the support of the object within the box is no longer provided in as satisfactory a manner as it could have been for a packaging box without damper flaps but having an internal volume of an exactly complementary shape to that of the object. The damping of the object during a shock is obtained to the detriment of the support of the latter within the packaging box, since, to obtain such a damping effect, it is necessary to release, at least partly, the support of the object to be able to brake any movement and thus attenuate the transmission of the shock wave to the internal components or elements of the object. In other words, the presence of one or more damper flaps deteriorates the support of the object within the internal volume of the packaging box in favour of the damping.

The purpose of the present invention is to remedy at least this disadvantage and, particularly, to supply a packaging box providing both a support and a damping of the object effective in the event of shocks received by a packaging box.

For this purpose, according to the invention, a box for packaging an object, preferably of parallelepipedic shape, comprising at least two upper edges, said box comprising:

lateral walls, a delimiting bottom, with the lateral walls, an internal volume able to receive said object, and a moving cover in relation to at least one of said lateral walls, so as to be able to occupy at least one closed position and one open position, in which said receiving volume is respectively closed and open, is remarkable by the fact that the cover comprises, on its internal face oriented toward the receiving volume, at least two main damper flaps that are arranged opposite each other and that are designed to be applied respectively against the upper edges of said object, when the cover occupies the closed position, so as to notably enable the object to be supported within the receiving volume against said bottom.

Hence, from the present invention, the damper flaps of a packaging box can produce—by their simultaneous application against two edges of an object to transport—both a damping for the object in the case of an impact and support for the latter within the receiving volume of the box against the bottom of the latter, when the cover is in the closed position.

In other words, the cooperation of both damper flaps together—linked to each other by means of the object in closed position of the cover—can allow an effective damping to be obtained without deterioration, for as much, of the support of the object to transport.

It will be understood that each packaging box in accordance with the present invention must have dimensions and a shape adapted to those of the relevant object.

Furthermore, in an embodiment in accordance with the present invention, said main flaps each preferably comprise an inclined face, oriented towards the inside of the receiving volume, against which is designed to contact the corresponding protruding edge of said object, in the closed position of the cover.

Hence, the inclination of the main flaps in relation to the cover can obtain—once the cover is maintained in closed position—a damping of the relevant object according to at least two different directions (for example orthogonal) belonging to the same plane.

Furthermore, each of said main flaps can advantageously be formed by a longitudinal extension of the cover which is folded along two separate folding axes, so as to define said inclined face.

In an advantageous embodiment of the invention, the flaps and lateral walls only form one single part, thus facilitating the manufacture of the box. As a variant, it could be considered attaching, for example by gluing, each of the main flaps onto the corresponding lateral wall.

Advantageously, the inner extremity of each main flap is free, which enables it to move when it is subjected to a particular force (for example in the case of impact), in order to prevent or reduce physical deformation.

Preferably, each main flap comprises an orthogonal face to the cover, which is defined between the two associated folding axes and which is designed to be applied against one of said lateral walls of the box, when the cover occupies the closed position.

In this manner, some of the force exerted on a main flap can be offset against the corresponding lateral wall opposite the considered orthogonal face, which can participate in the support of the cover in closed position while limiting its deformation.

Moreover, said main flaps are, preferably, formed from a flexible material, for example cardboard, so as to be able to absorb impacts without any risk of definitive and irreversible deformation. The flaps of the main wings can also provide permanent support for the object in the packaging box.

Furthermore, said box can advantageously comprise two internal lateral walls arranged opposite each other, so as to define a housing able to receive said object with adjustment, each internal wall being extended longitudinally, at each of its two extremities, by at least one auxiliary damper flap able to press against one of the lateral walls of the box.

Hence, the auxiliary flaps dampen any movement of the object along a direction for example orthogonal to the damping direction or directions associated with the main flaps. They can also contribute to supporting the object in the box.

Advantageously, said bottom can comprise additional means of damping on which said object is designed to rest.

In particular, said additional damping means can comprise at least two additional damper flaps on which said object can rest.

Hence, in the case where the packaging box comprises main, auxiliary and additional flaps as defined previously, the object housed in the corresponding housing is fully suspended in said receiving volume, which can provide an integral damping in the case of shocks.

The present invention relates to a part, for example in cardboard, to obtain, by successive folding operations, the packaging box as described previously.

Such a part, advantageously flat, preferably has cuts enabling the different folding operations.

The figures of the annexed drawing will provide a good understanding of how the invention can be implemented. In these figures, identical references designate similar elements.

Figure 1:
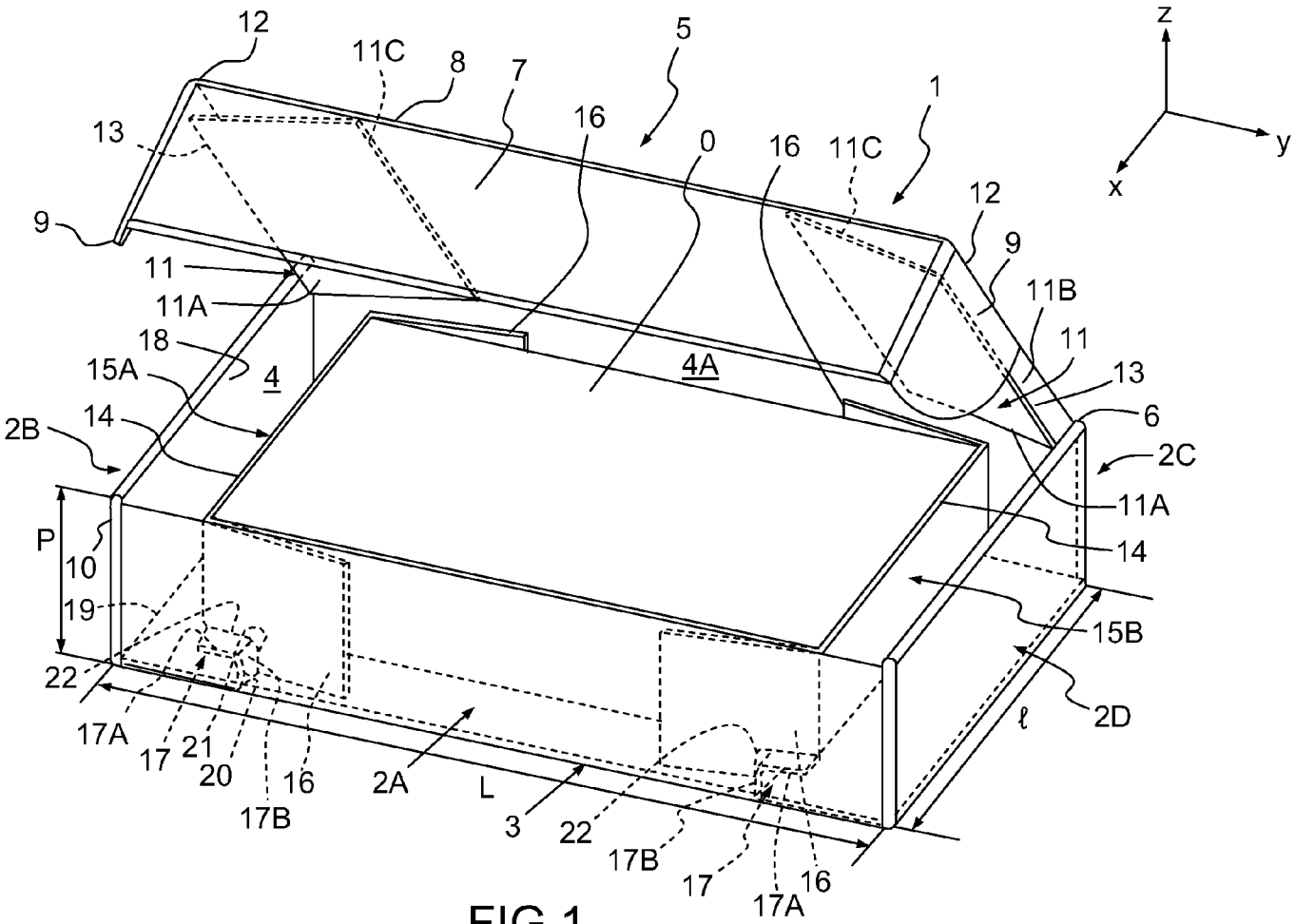
FIG. 1 shows, in a diagrammatic perspective diagonal view, an embodiment of a packaging box in accordance with the present invention, its cover occupying an open position.
Figure 2:
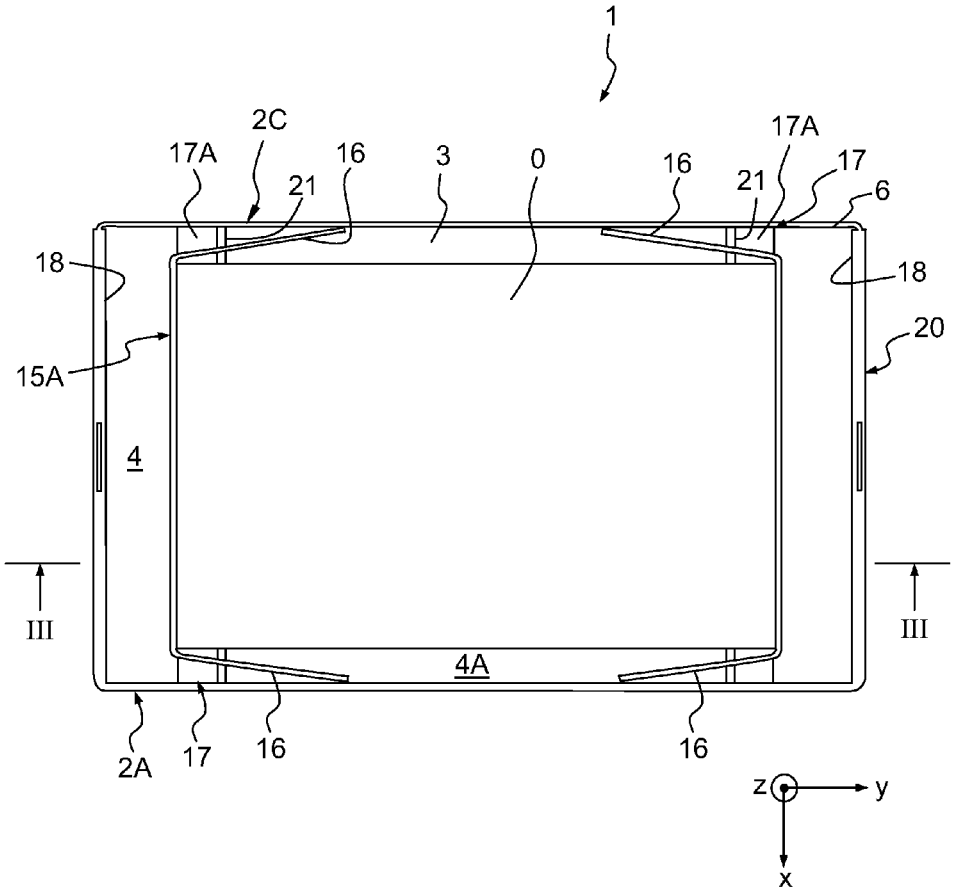
FIG. 2 is a diagrammatic top view of the receiving volume of the packaging box of FIG. 1, the cover not being shown.
Figure 3:
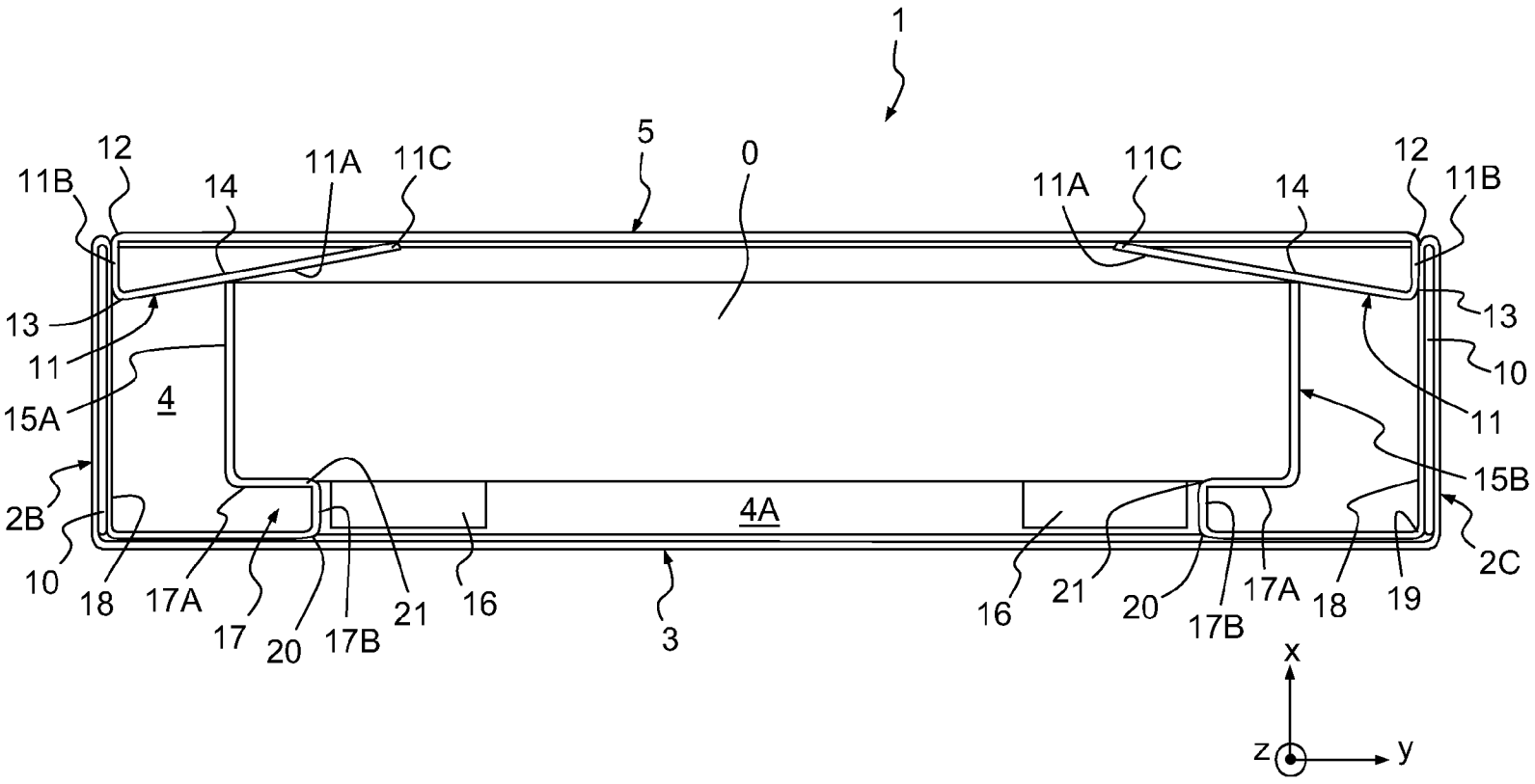
FIG. 3 is a cross-section diagrammatic view along the line III-III of FIG. 2 of the packaging box, the cover being arranged in closed position.

In FIGS. 1 to 3, according to an embodiment compliant with the present invention, a box 1 has been shown for packaging an object O having the form of a rectangular parallelepiped.

Naturally, it will be understood that the present invention is in no way limited to objects having the aforementioned shape, but can be adapted to objects of any other shape.

Moreover, and a previously stated, the dimensions and shape of the packaging box 1 are obviously defined according to the dimensions and shape of the object to pack O.

In the following, and by convention, the packaging box 1 is defined by a width l, a length L and a depth p that extend respectively along directions x, y and z of orthonormal axes (x, y, z) associated with said box 1. Moreover, the notions front/back, left/right and top/bottom are defined in relation to the directions x, y and z: the directions of the arrows of the axes (x, y, z) showing the passage from front to back, left to right and bottom to top.

As the figures show, the packaging box 1 comprises in a known manner:

- lateral walls 2A, 2B, 2C and 2D that define a peripheral belt,
- a bottom 3 that delimits, with the lateral walls 2A to 2D, an internal volume 4 designed to receive the object O,
- a cover 5 that is mobile in relation to the lateral walls 2A to 2D to be able to occupy at least one closed position (FIG. 3) and an open position (FIG. 1), in which the receiving volume 4 is respectively closed and open. It will be noted that the open position can correspond to a multitude of inclinations of the cover 5, apart from the one associated with the closed position (in which the cover has an angle of 90° with the direction z).

In particular, the cover 5 is connected to the rear lateral wall 2C of the box 1 along a folding line 6 extending in the direction y. It comprises:

- a mobile front strip 7 able to be folded back against the lateral wall 2A, along a folding line 8 extending in the direction y, and
- support flanges 9 able to be introduced into the corresponding slots 10 formed at the front longitudinal extremities of the left 2B and right 2D lateral walls, when the front strip 7 is folded back against the lateral wall 2A (the cover thus occupying the closed position of FIG. 3).

As a variant, the cover can be separate from the lateral walls and be attached to the peripheral belt of the packaging box.

According to the invention, as illustrated in FIGS. 1 and 3, the cover 5 also comprises, on its internal face oriented toward the receiving volume 4, two main damper flaps 11, arranged at the left and right longitudinal extremities of the latter. The main flaps 11 are arranged opposite on the internal face of the cover 5.

Naturally, as a variant, the number and position of the main flaps 11 could be different. Hence, it is possible, for example, to have two or more main flaps on the same edge of the cover, or else even design a main flap at the level of each extremity of the cover (there would be at least four main flaps in this last case).

In the example, each main flap 11 is formed by a longitudinal extension of the cover 5, folded along two separate folding axes 12 and 13 parallel with each other and perpendicular to the folding axis 8.

Hence, each of the main flaps 11 comprises:

- and inclined face 11A against which the corresponding projecting edges 14 of the object O can rest, when the cover 5 occupies the closed position (FIG. 3), and
- and orthogonal face 11B to the cover 5 defined between two folding axes 12 and 13. The orthogonal face 11B is applied against the internal face of the corresponding lateral wall 2B, 2D, once the cover 5 is in closed position.

Moreover, the interior extremity 11C of each main flap 11 is free, which enables it to move in relation to the internal face of the cover 5 according to the constraints that are applied to it and simplifies the manufacture of the box 1 (no gluing for example being essential).

Moreover, in the example and in accordance with the invention, the packaging box 1 comprises two internal lateral walls 15A and 15B which are arranged opposite each other (see FIGS. 1 and 2).

Owing to the shape of the object to transport considered, the internal lateral walls 15A and 15B are, in the example, noticeably parallel to the lateral walls left 2B and right 2D, respectively.

They define a housing 4A able to receive the object O with adjustment. In other words, the distance between the internal walls 15A and 15B can be advantageously defined according to the corresponding dimensions of the object O (its length in the example), so as to hold it supported in the receiving volume 4.

Each internal wall 15A, 15B is extended longitudinally at each of its two front and back extremities, by an auxiliary damper flap 16 able to rest against the internal face of the corresponding lateral wall opposite 2A or 2C of the box 1. The width separating two auxiliary flaps 16 of a same internal wall 15A, 15B corresponds advantageously to the width of the object O. The inclination of the auxiliary flaps 16 prevents, or at least reduces, the movement of the object O from the front to the back, and conversely, in the direction x.

In the example of FIGS. 1 to 3, the packaging box 1 further comprises two additional damper flaps 17 against which the object O can rest. In other words, it rests against the bottom 3 of the box 1 by means of the additional flaps 17.

Each additional flap 17 is defined by an extension of the fold 18 partially forming the corresponding right 2D or left 2B lateral wall. The extension of the fold 18 is folded three times along three folding axes 19, 20 and 21 parallel to the direction x, such that the additional flap 17 comprises:

an inclined lateral strip 17A defined between the folding axis 21 and the extremity of the extension of the fold 18. The inclined strip 17A can become parallel to the bottom 3 of the box 1, once the object is inserted into the housing 4A, and a lateral strip 17B noticeably orthogonal to the bottom 3.

The additional flaps 17 extend along the direction x between the two lateral walls front 2A and back 2C.

As shown in the example of FIG. 1, the low extremity of the internal lateral walls 15A and 15B coincides, at least partly, with the free extremity of the corresponding additional flap 17. Advantageously, the extension of the fold 18 and the associated internal wall 15A, 15B can only form a single part.

Further, each auxiliary flap 16 has a notch 22, in which are received the lateral strips 17A and 17B of the associated additional flap 17. Hence, each auxiliary flap 16 remains free to move from the front to the back and conversely, while remaining in contact, or at least near, the internal face of the bottom 3.

In the example, the main 11, auxiliary 16 and additional 17 flaps are formed in a flexible material, such as cardboard for example, which enables them to be deformed slightly when stress is applied to them.

Preferably, the packaging box 1 of FIGS. 1 to 3 is formed from a single part, for example of cardboard. It is obtained by successively folding different elements along predefined folding lines. The manufacture of the packaging box 1 is thus greatly facilitated, no gluing being required.

The main flaps 11 and the additional flaps 17 are dimensional by taking into account the dimensions of the object to package, such that once the object O is housed in the volume 4 and the cover arranged in the closed position, the main flaps 11 are slightly under stress by the projecting edges 14 (the free edge 11C of the flaps 11 is thus placed in contact with the internal face of the cover 5). Doing this, the object is held effectively supported inside the packaging box 1.

Naturally, as a variant, the number and position of the additional flaps could be modified. For example, these additional flaps could be arranged in the direction of length (direction y) rather than in that of width (direction x). They could also be more or less inclined in relation to these directions.

Hence, due to the present invention, closing the cover 5 places the main damper flaps 11 in contact with the projecting edges 14 of the object O, to push it against the bottom 3, by means of the additional flaps 17. The inclination of the main flaps 11 can enable a damping in at least two different directions, particularly perpendicular to each other. Moreover, the lateral walls 15A and 15B can provide, with the main flaps and the bottom 3, effective support for the object O without hampering the damping obtained by the main 11, auxiliary 16 and additional 17 flaps. The object O can thus be held supported while being damped in the case of shock, which preserves the internal components or elements of the latter.

Naturally the present invention is in no way limited to the above-described embodiment.

It will further be understood that the support and damping of the object to transport can be obtained only using the main flaps 11, the object resting directly on the bottom 3. In this latter case, the box 1 does not have auxiliary flaps 16, additional flaps 17 and internal lateral walls 15A, 15B.

The invention claimed is:

1. A box, comprising:

lateral walls having a dimension;

a bottom panel connected to and defining, with the lateral walls, an internal volume able to receive an object; and a movable panel connected in relation to one of the lateral walls, so as to be able to occupy at least one closed position and one open position, in which the internal volume is respectively closed and open;

wherein the movable panel comprises, on an internal face oriented towards the internal volume, at least two main flaps that: (i) are arranged opposite to each other and are formed by a longitudinal extension of the moveable panel, and (ii) are applied against edges of the object;

wherein the box comprises two internal lateral walls arranged opposite to each other to define a housing able to receive the object with adjustment, each of the internal lateral walls being extended longitudinally at each end by two auxiliary damping flaps able to press against one of the internal lateral walls of the box;

wherein the bottom panel comprises at least two additional damping flaps on which the object can rest; and wherein each of the auxiliary damping flaps has a notch configured to receive one of the additional damping flaps.

2. The box according to claim 1, wherein the main flaps each comprise an inclined face oriented towards an inside of the internal volume, and each of the inclined faces contacts a corresponding protruding edge of the object in the closed position of the moveable panel.

3. The box according to claim 2, wherein each longitudinal extension of the moveable panel is folded along two separate folding axes, so as to define the inclined face.

4. The box according to claim 2, wherein an inner end of each of the main flaps is free.

5. The box according to claim 1, wherein each of the main flaps comprises an orthogonal face to the moveable panel which is defined between two associated folding axes and which engages one of the lateral walls of the box when the moveable panel is in the closed position.

6. The box according to claim 1, wherein the main flaps are formed from a flexible material.

7. The box according to claim 6, wherein the flexible material is cardboard.

8. A method, comprising:

providing a box having an internal volume able to receive an object, wherein the box comprises:

lateral walls having a dimension;

a bottom panel connected to and defining, with the lateral walls, the internal volume; and a movable panel connected in relation to one of the lateral walls, so as to be able to occupy at least one closed position and one open position, in which the internal volume is respectively closed and open;

wherein the movable panel comprises, on an internal face oriented towards the internal volume, at least two main flaps that: (i) are arranged opposite to each other and are formed by a longitudinal extension of the moveable panel, and (ii) are applied against edges of the object;

wherein the box comprises two internal lateral walls arranged opposite to each other to define a housing able to receive the object with adjustment, each of the internal lateral walls being extended longitudinally at each end by two auxiliary damping flaps able to press against one of the internal lateral walls of the box;

wherein the bottom panel comprises at least two additional damping flaps on which the object can rest; and wherein each of the auxiliary damping flaps has a notch configured to receive one of the additional damping flaps.

9. The method of claim 8, wherein the main flaps each comprise an inclined face oriented towards an inside of the internal volume, and each of the inclined faces contacts a corresponding protruding edge of the object in the closed position of the moveable panel.

10. The method of claim 9, wherein each longitudinal extension of the moveable panel is folded along two separate folding axes, so as to define the inclined face.

11. The method of claim 9, wherein an inner end of each of the main flaps is free.

12. The method of claim 9, wherein each of the main flaps comprises an orthogonal face to the moveable panel which is defined between two associated folding axes and which engages one of the lateral walls of the box when the moveable panel is in the closed position.

13. The method of claim 8, wherein the main flaps are formed from a flexible material.

14. The method of claim 13, wherein the flexible material is cardboard.

* * * * *